US008853514B2

(12) United States Patent
Cox, Jr.

(10) Patent No.: US 8,853,514 B2
(45) Date of Patent: Oct. 7, 2014

(54) WOOD STAVE DRUM WITH OPTO/ACOUSTIC SHELL WINDOWS

(75) Inventor: Edwin Reed Cox, Jr., Goshen, OH (US)

(73) Assignee: Edwin Reed Cox, Jr., Goshen, OH (US)

( * ) Notice: Subject to any disclaimer, the term of this patent is extended or adjusted under 35 U.S.C. 154(b) by 50 days.

(21) Appl. No.: 13/605,945

(22) Filed: Sep. 6, 2012

(65) Prior Publication Data

US 2013/0055878 A1 Mar. 7, 2013

Related U.S. Application Data

(60) Provisional application No. 61/531,884, filed on Sep. 7, 2011.

(51) Int. Cl.
*G10D 13/02* (2006.01)

(52) U.S. Cl.
CPC ..... *G10D 13/02* (2013.01)
USPC ..... 84/411 R

(58) Field of Classification Search
USPC ..... 84/411 R
See application file for complete search history.

(56) References Cited

U.S. PATENT DOCUMENTS 1,475,897 A * 11/1923 Sutherland ..... 217/44
D163,538 S * 6/1951 Orta ..... D17/22
2,913,954 A * 11/1959 Morgan ..... 352/2
3,346,732 A * 10/1967 Crusius ..... 362/86
3,791,249 A 2/1974 Frigo
4,045,264 A * 8/1977 Ludwig et al. ..... 156/63
4,091,706 A * 5/1978 Ludwig ..... 84/411 R
4,173,917 A 11/1979 Della-Porta
4,353,008 A * 10/1982 Dorfman ..... 315/114
4,522,006 A * 6/1985 Plikuhn ..... 52/585.1
4,660,455 A * 4/1987 Jones et al. ..... 84/413
4,993,304 A 2/1991 Lovelet
5,136,487 A * 8/1992 Schmidt ..... 362/86
5,280,742 A * 1/1994 Vergara ..... 84/411 R
5,301,591 A * 4/1994 Greenberg ..... 84/411 R
5,377,576 A 1/1995 Good et al.
5,606,142 A 2/1997 Volpp
5,922,981 A * 7/1999 Ballister ..... 84/464 A
6,057,499 A * 5/2000 Basmadjian ..... 84/411 R
6,198,033 B1 * 3/2001 Lovelett ..... 84/411 R
6,300,551 B1 10/2001 Adinolfi
6,700,044 B1 * 3/2004 Bencomo, Jr. ..... 84/411 R
6,838,605 B2 1/2005 Belli
6,921,854 B2 7/2005 Gatzen
7,148,413 B2 * 12/2006 May ..... 84/411 R (Continued)

OTHER PUBLICATIONS

My First Snare Drum "Build"—Drummerworld Official Discussion Forum, zambizzi, post dates Dec. 30, 2008 and Oct. 18, 2010, viewed at http://www.drummerworld.com/forums/showthread.php?t=45584 on Dec. 9, 2013.*

*Primary Examiner* — Robert W Horn
(74) *Attorney, Agent, or Firm* — Frost Brown Todd LLC

(57) ABSTRACT

A musical drum comprising a drum shell made of wood staves is provided. The drum shell has cutout sections which are positioned so as to achieve desired acoustical properties for the drum. The cutout portions of the drum shell can also be filled with other materials to further modify the acoustical properties of the drum and lighting can be provided in the interior of the drum allowing light to be passed through the cutout portions of the shell. The light passing through the cutout portions of the drum can be excited by the conditions of play.

11 Claims, 1 Drawing Sheet

(56) References Cited

U.S. PATENT DOCUMENTS

| | | | | |
|---|---|---|---|---|
| 7,485,791 | B2 * | 2/2009 | Takegawa | 84/411 R |
| 7,652,206 | B2 * | 1/2010 | Okamoto | 84/411 R |
| 7,692,082 | B2 * | 4/2010 | Abe | 84/411 R |
| 7,851,687 | B2 * | 12/2010 | Chang et al. | 84/464 R |
| 8,035,018 | B2 * | 10/2011 | Bausch, III | 84/411 R |
| 2008/0271588 | A1 | 11/2008 | van der Meulen | |
| 2009/0019985 | A1 * | 1/2009 | Casanta | 84/411 R |
| 2010/0107853 | A1 * | 5/2010 | Bausch, III | 84/411 R |
| 2013/0055878 | A1 * | 3/2013 | Cox, Jr. | 84/411 R |

* cited by examiner

WOOD STAVE DRUM WITH OPTO/ACOUSTIC SHELL WINDOWS

CROSS REFERENCE TO RELATED APPLICATION

This application claims benefit of co-pending U.S. Provisional Patent Application No. 61/531,884 filed Sep. 7, 2011.

BACKGROUND OF THE INVENTION

The musical drum is believed to be the earliest instrument developed by man. Drum evolution has continued from the earliest times and continues in the present. Today, modern musical drums are often made by wrapping numerous plies, usually thin sheets of wood or other material, into a laminated annular ring with an annulus of varying length depending on the properties that one desires for the particular drum construction. The annulus is called a drum shell.

Over the end or ends of the annulus a drum head, made of plastic, hide or other flexible material is stretched to provide a resonating surface which can be struck to create the sound made by the drum.

Often only one end of the drum shell is covered with a drum head, but when both ends of the annulus are covered, the end that is made to be struck with the hand or some other beater such as a drumstick or a mallet is called the batter head and the opposite head is called the resonance head.

To get the maximum range of effectiveness from a drum it is desirable to imbue a drumhead with the potential for as many vibrational modes as possible. The more perfectly circular the drum is; the easier it will be to excite a range of vibrational modes in the drum head. For a circular drum head these modes can be defined mathematically by Bessel functions, and they correspond to patterns of nodes and antinodes on the vibrating surface of the drumhead. Each mode further corresponds to its own set of vibrational displacements of the drumhead with modes that exhibit more complex arrangements of nodes and antinodes producing higher frequency sounds from the drum.

The bearing edge of the drum heads, that is the edge over which the drum head material is stretched, places boundary conditions on the vibrations of the heads, and any permitted deformation at the edge can lead to different drum sounds. Various edge angles are commonly machined into bearing edges to control edge deformations as the vibrations approach the edge of the drum head. Drums can be tuned by varying the tightness of the stretch to control these edge deformations, and the overall sound of particular kinds of drums are often dependent on how much edge deformation is allowed.

Although many drum enthusiasts emphasize the importance of the drum heads to the tuning and sound made by the drum, the nature of the drum shell is also of fundamental importance to the overall sound made by any particular drum.

For example, when a thin laminated shell is used, such as an eight ply shell, the resulting drum usually has a lower pitch and has a darker tone. On the other hand thick shells tend to have a brighter tone with higher pitch and tend to project well in a loud musical environment.

Other shell designs are common such as using a thin shell as discussed above but adding reinforcing hoops at the top and/or bottom of the shell. This leads to a more general purpose kind of drum providing a range of tones between the high and low tones discussed above.

Laminated drum shells employ various adhesives to hold the laminates together. These adhesives usually have poor acoustical properties and tend to act as sound deadeners in the shells leading to poorer resonance than would otherwise be provided by the shells.

In contrast to laminated shell drums, wood stave drums are made by methods similar to constructing a wooden barrel. To make these drums individual pieces of wood are cut and shaped to fit together to form a shell. The pieces can be joined together by various methods such as butting, splining, or even tongue and groove and are often held together using an adhesive. As with a wooden barrel, the resulting structure is strong and unyielding largely due to the approximately circular geometry of the structure. Once joined, the shell can be machined to a circular shape both inside and outside the shell. Often wood stave shells are simply turned on a lathe to smooth their surfaces and make them round.

The tonal response of such a drum is enhanced by the solid wood shell. Wood stave drums exhibit excellent musical response as well. Much of this is attributable to the usually vertical grain pieces of wood from which the staves are cut with the bearing edges of the drum at the end of the grain extending from stave to stave substantially perpendicular to the grain so that the plane of the drum head is substantially perpendicular to the grain of the staves. These vertical grain structures conduct the drum head vibrations through the shell very effectively.

Further, when used, adhesive bonding between the staves does not attenuate shell vibrations the way a laminar structure does. In the case of a laminar shell the drum head rests on the bearing edge with the plane of the drum head nearly always parallel to the grain of at least some of the laminates. This configuration is necessary because the strength of the laminated plies of the drum shell need to be parallel to the circumference of the laminated shell to strengthen the shell so that the plies will not break.

In addition the actual quantity of acoustically deadening adhesive used in a wood stave drum is much less than that used in a laminate drum shell. Some estimates have placed the adhesive used to construct a wood stave shell at about 0.0001 of that used for a 9 ply glue laminate shell.

All of this leads to wood stave drums with consistently true, melodic tones high in quality when compared to laminated shell drums.

The ability of head vibration to be transferred to the shell can have a substantial effect on the sound of a drum. Similarly, the design of a shell can significantly change the sound of a drum. Most drums are made of wood, and shell resonance is at least partially dependent on the kind of wood used.

Sound vibrations tend to be carried through harder and denser woods more efficiently than they are through softer, less dense woods giving harder woods higher tones with more projection and softer woods lower tones with less projection. Nevertheless, each kind of shell wood has its own properties with regard to frequency distribution giving each wood used a different sound.

In modern drum performances the look of the performers' instruments can be as important as their sound. Because of this, recent drum constructions have employed all kinds of decoration from bright colors to internal lighting inside drum shells sometimes responsive to individual beater strikes.

Though not commonly employed, drum vibration can be changed by inserting acoustic modifiers into the shells. Modification has been accomplished by various methods from fabric pads attached to the shells to modifying drum shells with breather holes.

Hence, drums are now at the evolutionary point where sounds as well as looks are important and new methods of accomplishing new designs incorporating both are needed.

BRIEF DESCRIPTION OF THE INVENTION

A wood stave musical drum having cutouts with translucent panels disposed in the shell of the drum capable of passing light through the shell of the drum is provided.

A wood stave musical drum having cutouts in the shell of the drum that change the acoustic vibrations excited in the shell of the drum when the drum is struck from vibrations that occur in a similar drum without cutouts is provided.

DETAILED DESCRIPTION OF THE INVENTION

Figure 1:
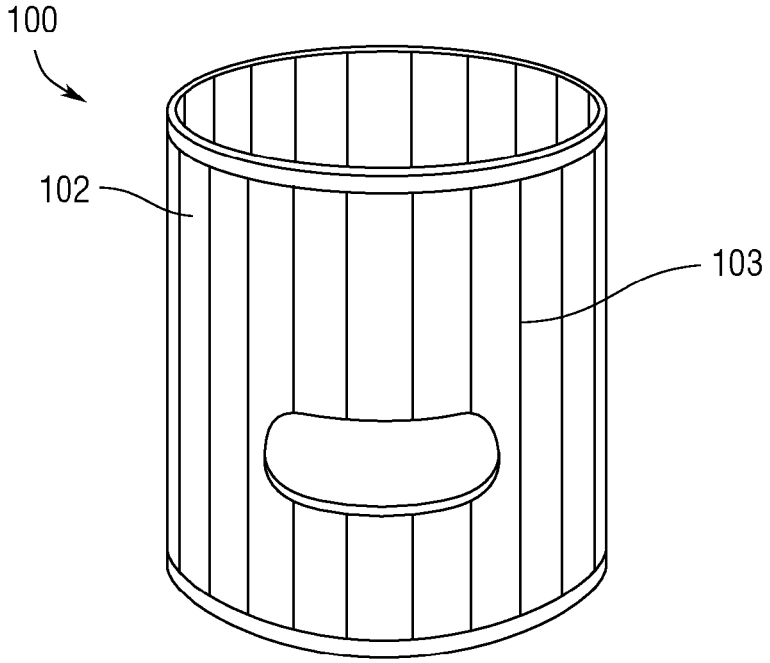
FIG. 1 is a musical stave drum having a cutout in the shell of the drum.

Wood stave drums can be assembled from individual staves that are cut and shaped to fit together so as to form a polygonal shell shape while providing an essentially round circular bearing edge at the top and at the bottom of the formed shell. These drums are extremely robust, and their shells are remarkably durable in comparison to those of a laminar drum which comprises large amounts of adhesive for bonding together thin breakable plies.

New shaping methods have recently been developed that allow one to cut and shape wood blanks intended for shell staves individually so that the resulting constructed shell is sufficiently round to ensure excellent resonant vibrations in the drumhead and shell without further machining. As discussed above, the rounder the drum shell is at the bearing edge, the better the performance of the drum. For extremely precise roundness of the drum head, the wood staves can be shaped by lathe at the top and, if needed, the bottom of the drum.

In some cases wood stave drums are shaped by lathe to make the whole drum round inside and/or out but these shaping methods are largely unnecessary when the modern methods of construction described above are used.

Drums constructed for modern performances must not only perform well with regard to acoustics, but they also need to be attractive or suggestive on the basis of appearance.

Further, for versatility it is possible to modify the sound of a drum by changing certain aspects of its construction. As discussed above, beyond excitations of a drum head, the sound of a drum depends on its shell. It has been found that sound changes can be achieved by modifying the drum shell, especially in wood stave drums.

A wood stave musical drum has been designed which can be tuned to a variety of tones, projection, resonance, brightness, attack and other parameters based on features of the drum shell to affect the overall sound of the drum.

The drum has cutouts or openings in the shell of the drum that can be used to manipulate the sound and appearance of the wood stave drum. These cutouts can be left open, completely filled or partially filled with acoustically modifying materials to achieve a desired acoustical quality. By suitably choosing the disposition of the cutouts and cutout filling materials and their application, various appearance and acoustical features can be achieved.

The resonance of the drum can be modified by suitably blocking or opening the cutouts, and the appearance of the drum can be modified by choosing various appearance modifying materials and applications to change the look or enhance the look of the drum.

In one embodiment a wooden stave musical drum having translucent panels disposed in openings in the shell of the drum is constructed and is capable of passing light through the cutout parts of the shell of the drum when the panels are in place. In this embodiment the panels fill the openings in the shell.

In another embodiment the panels disposed in the shell of the drum can be made of a clear acoustical material such that the inside of the drum can be clearly seen from outside the shell of the drum.

In yet another embodiment decorative panels, sometimes with relief images on them, are used to enhance the appearance of the drum.

In one embodiment shown in FIG. 1 a wood stave drum 100 with cutouts 101 in the sides of the drum 100 can be cut across the staves 102 spanning one or more joints 103 between the staves. These can give rise to larger windows in the sides of the shell and can change the acoustical performance of the drum by introducing additional boundary conditions on the waves excited in the shell. These boundary conditions change the resonant wavelengths in the shell creating a mix of acoustic wavelengths that give the drum uniquely tuned characteristics and a unique sound.

The mix of cutout geometries works to select the relative density of particular sound waves output by the drum and can give rise to unique tonal qualities along with visual interest when combined with the optical adjustments described herein.

Figure 2:
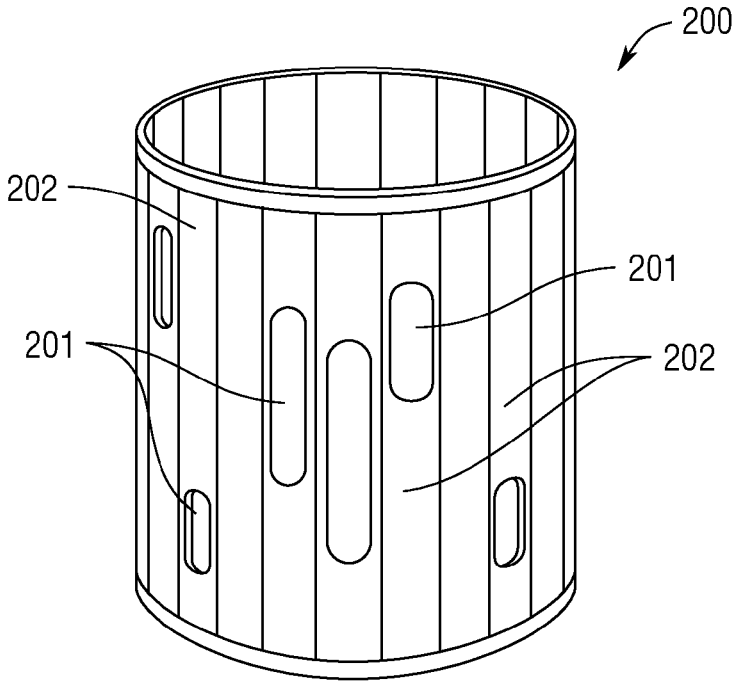
FIG. 2 is a musical stave drum having cutouts disposed in the shell of the drum at several locations.

Another embodiment places the cutouts 201 in the drum 200 in individual staves 202 as shown in FIG. 2. In this way individual staves 202 can be tuned to produce a particular sound or combination of sounds depending on the shape of the cutout 201 and its dimensions. These staves 202 can then be assembled to make a drum 200 possessing not only the combination of sounds from the individually modified or unmodified staves 202, but a drum 200 that can benefit from the sympathetic vibrations created in other staves 202 by sounds created in adjacent staves 202.

The situation can become quite complicated and experimentation is necessary to create the exact sounds desired, but with practice one so skilled in the art can become quite adept at creating customized drums with unique sounds.

While the placement and sizes of the cutouts can have effects on the sound of the drum as discussed below, the cutouts create opportunities for other drum treatments and enhancements. For example, when it is possible for light to pass through the cutouts, lighting effects can be used to modify the look of the drum.

In one embodiment lighting is placed inside the drum that can be seen through the cutouts imparting the ability to change the look of the drum by changing the features of the lighting such as color, intensity, luster, luminosity or radiance.

In another embodiment lighting can be placed inside the drum that is made sensitive to strikes on the drum with sound exciting beaters such as drum sticks, mallets or other methods of drum head excitation. For example, internal lighting could be made to flash with each strike when playing the drum. In this way, the drum can create sounds with corresponding optical definition as the drum is played, and the light originating inside the drum can be seen through the cutouts in the sides of the drum.

These effects can be further enhanced when the cutouts are filled or partially filled with translucent or even clear materials such as glass, plastic, biological materials such as animal horn, or with other materials possessing other optically interesting properties.

The enhancements made possible by transmission of light through the sides of a drum when it is being played made possible by the use of cutouts, also identified as openings herein, can dramatically improve the entertainment experience during wood stave drum performance. Coordinating light with sound effects during performance can raise audience interest leading to an improved level of entertainment quality and offering an opportunity to substantially improve the overall performance.

In modern performances transparent drum heads employing light effects from inside the drum are sometimes used to add interest to drum performances. This works well when the drum heads can be oriented toward the audience. However, when drums that require the drum heads to be oriented away from the view of the audience are used, such as with snare drums, light displays have been limited. The use of wood stave drum shells with cutouts changes this from a visual perspective allowing many additional kinds of drums to display lighting effects.

In addition even drums that permit light to show through their drum heads can benefit in terms of appearance from being made with wood staves and shell cutouts. The cutouts can allow more light to escape from inside an interiorly lit drum adding to visual interest and light visibility in additional directions from which the drum can be viewed. The overall effect can increase audience appreciation of performances sometimes even making the drum to be pulsingly alive.

From an acoustical aspect, as discussed above, the size and position of the cutouts can change the resonant characteristics of the drum shell. In so doing the sound of the drum can be changed. This, when combined with adjustments to the drum head, imparts the ability to finely tune drum sounds for the specific kind of music being played.

The resonance properties of a drum have been found to be dependent on not only the position of the cutouts, but on their size as well. Further, when the cutouts are filled with a material, the acoustical properties of the material can contribute to modification of the drum tone and projection. In addition the cutouts can be either completely filled or can be partially filled with a material such as the clear or translucent materials discussed above to further modify the drum sound. All of these possible methods of sound modification can be used to tune a drum for specific sound or projection properties giving rise to the ability to provide wood stave drums that are not only visually attractive and interesting from a performance perspective but are capable of specific acoustical performance.

Drum heads on a stave drum can be installed using drum hoops tensioned by drum lugs mounted on the shell and tightened with tensioning rods through the drum hoops. The mounting of these lugs can also significantly affect the resonant characteristics of the drum shell forcing nodes and antinodes to occur at specific points on the drum shell.

For that reason, drum lugs known as low mass drum lugs can be used to minimize contact and subsequent modification of the drum shell thus reducing unintended acoustic changes due to the lugs. Low mass lugs are designed to have minimal contact with the shell so that the shell can resonate more freely affecting the tone and overall sound of the drum.

Drum hoops are usually made of either metal or wood. The drum hoops stretch the drum head material over the bearing edges of the drum and usually feature holes through which tensioning rods can be placed to draw down on the head material. In most drums the drum hoops are made to rise substantially above the bearing edge of the drum often to protect the drum head material covering the bearing edge from damage due to stray beater strikes while playing the drum.

Played not only with drum head excitation from a mechanical beater such as a drum stick or mallet, wood stave drums are often played using hand or finger strikes as well. Because of this, high rising drum hoops are undesirable because they impede finger or hand movement and make it difficult to contact the drum head in the way the playing artist requires to get the full range of playing effects available from the drum.

In another embodiment, the drum uses low rising drum hoops that extend minimally above the drum head and allow the hand of the drum player to easily wrap around the edge of the drum so that the hand and fingers fall on the drum head without the annoyance and limitations caused by a drum hoop that rises substantially above the plane of the drum head.

Those skilled in the art will realize that this invention is capable of embodiments different from those shown and described. It will be appreciated that the detail of the structure of this apparatus and methodology can be changed in various ways without departing from the scope of this invention. Accordingly, the drawings and detailed description of the embodiments are to be regarded as including such equivalents as do not depart from the scope of the invention.

I claim:

1. A musical drum comprising a wood stave shell having at least one cutout in the shell of the drum, the at least one cutout used to manipulate the acoustical properties of the drum, wherein a light transmissive panel is disposed in the at least one cutout to enhance the appearance of the drum, the panel capable of passing light through the shell of the drum.

2. The musical drum of claim 1 where the size and shape of the at least one cutout is chosen to modify the appearance of the drum.

3. The drum of claim 1 wherein the panel is designed to alter the sound of the drum.

4. The drum of claim 1 where the at least one cutout is disposed in an individual stave of the drum shell.

5. The drum of claim 1 where multiple cutouts are disposed in multiple staves modifying each stave to produce a particular sound and a combination of modified and unmodified staves are assembled to make a drum having desired acoustical properties that can benefit from the combination of vibrations excited in the drum when played.

6. The drum of claim 1 where the at least one cutout spans more than one stave of the drum shell.

7. The drum of claim 1 where the drum is lit from inside the shell of the drum so as to allow the light to pass through the at least one cutout.

8. The drum of claim 1 having an internal lighting system that responds to beater strikes on the drum when it is played passing light through the at least one cutout.

9. The drum of claim 8 where individual strikes on the drum can produce at least one flash of light by the lighting system.

10. The drum of claim 1 wherein adding a panel to at least partially fill the cutout improves the efficiency of sound projection through the side of drum.

11. The drum of claim 1 having a drum hoop with a rim recessed to be just slightly above a bearing edge to improve finger and hand playing.

* * * * *